US007427965B2

(12) United States Patent
Fabrega-Sanchez et al.

(10) Patent No.: US 7,427,965 B2
(45) Date of Patent: Sep. 23, 2008

(54) MULTIPLE BAND CAPACITIVELY-LOADED LOOP ANTENNA

(75) Inventors: Jorge Fabrega-Sanchez, San Diego, CA (US); Huan-Sheng Hwang, San Diego, CA (US); Alan Pasion, Carlsbad, CA (US); Gregory Poilasne, San Diego, CA (US); Mete Ozkar, Raleigh, NC (US)

(73) Assignee: Kyocera Corporation, Kyoto (JP)

( * ) Notice: Subject to any disclaimer, the term of this patent is extended or adjusted under 35 U.S.C. 154(b) by 94 days.

(21) Appl. No.: 11/674,564

(22) Filed: Feb. 13, 2007

(65) Prior Publication Data

US 2007/0216598 A1 Sep. 20, 2007

Related U.S. Application Data

(63) Continuation-in-part of application No. 11/248,665, filed on Oct. 12, 2006, now Pat. No. 7,274,338.

(51) Int. Cl.
*H01Q 9/28* (2006.01)

(52) U.S. Cl. ..... 343/795; 343/866; 343/895; 343/741

(58) Field of Classification Search ..... 343/700 MS, 343/702, 795, 741, 742, 866, 867, 803, 806, 343/895
See application file for complete search history.

(56) References Cited

U.S. PATENT DOCUMENTS

| | | | | |
|---|---|---|---|---|
| 3,882,506 | A | 5/1975 | Mori et al. | |
| H1571 | H | 8/1996 | Hansen et al. | |
| 6,144,346 | A | 11/2000 | Boy | |
| 6,204,817 | B1 | 3/2001 | Edvardsson | |
| 6,456,243 | B1 | 9/2002 | Poilansne et al. | |
| 6,486,848 | B1 | 11/2002 | Poilansne et al. | |
| 6,573,867 | B1 | 6/2003 | Desclos et al. | |
| 6,600,450 | B1 | 7/2003 | Efanov et al. | |
| 6,675,461 | B1 | 1/2004 | Rowson et al. | |
| 6,693,599 | B1 | 2/2004 | Chia et al. | |
| 6,697,025 | B2 | 2/2004 | Koyanagi et al. | |
| 6,765,846 | B2 | 7/2004 | Saitou et al. | |
| 6,900,773 | B2 * | 5/2005 | Poilasne et al. | 343/795 |
| 6,919,857 | B2 * | 7/2005 | Shamblin et al. | 343/795 |
| 6,943,730 | B2 * | 9/2005 | Poilasne et al. | 343/700 MS |
| 7,239,290 | B2 * | 7/2007 | Poilasne et al. | 343/866 |
| 7,274,338 | B2 * | 9/2007 | Ozkar et al. | 343/793 |
| 2006/0038730 | A1 | 2/2006 | Parsche | |

FOREIGN PATENT DOCUMENTS

| | | |
|---|---|---|
| DE | 8814993 | 3/1989 |
| EP | 1134840 | 9/2001 |
| EP | 1217685 | 6/2002 |
| WO | WO 02/071536 | 9/2002 |

* cited by examiner

*Primary Examiner*—Hoang V Nguyen

(57) ABSTRACT

A multiple band capacitively-loaded magnetic dipole antenna includes a plurality of magnetic dipole radiators connected to a transformer loop where the magnetic dipole radiators include at least one capacitively-loaded magnetic dipole radiator. The transformer loop has a balanced feed interface and includes a side that provides a transformer interface of quasi loops formed by the plurality of magnetic dipole radiators. Each quasi loop has a configuration and length to maximize antenna performance within a different frequency band. The at least one capacitively-loaded magnetic dipole radiator may be formed with a meander line structure and may include an electric field bridge such as a dielectric gap, lumped element, circuit board surface-mounted, ferroelectric tunable, or a microelectromechanical system (MEMS) capacitor.

20 Claims, 14 Drawing Sheets

RECTANGULAR / EQUAL PITCH

RECTANGULAR / EQUAL PITCH / UNEQUAL HEIGHT

THE MEANDERLINE CAN BE OFFSET

ZIG-ZAG SHAPE

ROUND SHAPE

Fig. 15
| Tx BAND | FREE SPACE | PHANTOM HEAD | DIFFERENCE | PHANTOM HAND | DIFFERENCE | PRELIMINARY SAR RESULTS |
|---|---|---|---|---|---|---|
| CONVENTIONAL ANTENNA | 20.8dBm | 14.9dBm | 5.9dB | 17.7dBm | 3.1dB | >1.3W/Kg |
| CAPACITIVELY-LOADED ANTENNA | 20.2dBm | 16.9dBm | 3.3dB | 20.2dBm | 0dB | 0.9W/Kg |
| DIFFERENCE | -0.6 | 2 | 2.6 | 2.6 | 3.1 | -0.4 |
Fig. 16
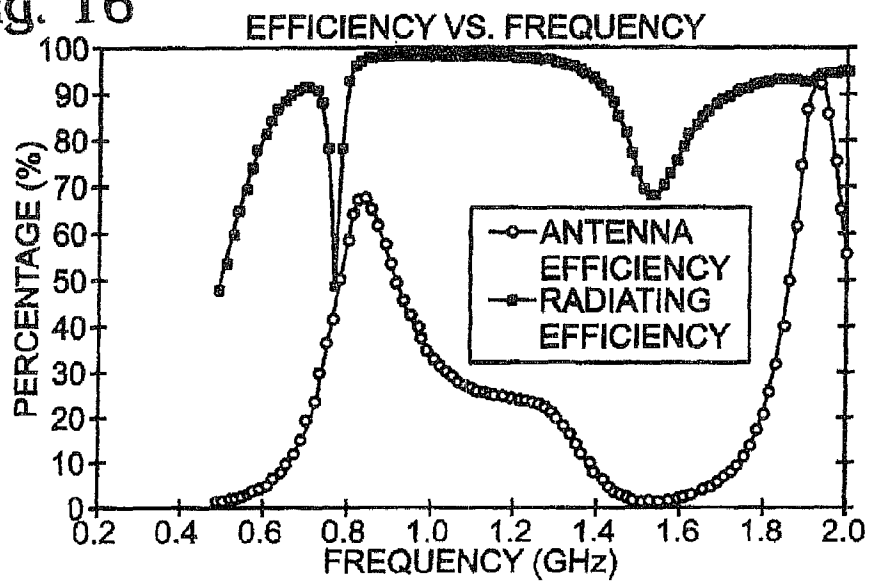
Fig. 14
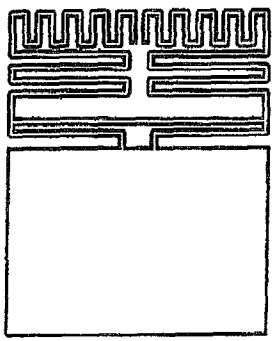

MULTIPLE BAND CAPACITIVELY-LOADED LOOP ANTENNA

RELATED APPLICATIONS

This is a continuation-in-part application of and claims the benefit of priority of U.S. patent application Ser. No. 11/248,665, filed on Oct. 12, 2006, now U.S. Pat. No. 7,274,338, and which incorporated by reference in its entirety, herein.

TECHNICAL FIELD

This invention generally relates to wireless communications and more particularly to a multiple band capacitively-loaded loop antenna.

BACKGROUND

The size of portable wireless communications devices, such as telephones, continues to shrink, even as more functionality is added. As a result, the designers must increase the performance of components or device subsystems while reducing their size and packaging these components in inconvenient locations. One such critical component is the wireless communications antenna. The antenna may be connected to a telephone transceiver, for example, or a global positioning system (GPS) receiver.

State-of-the-art wireless telephones are expected to operate in a number of different communication bands. In the US, the cellular band (AMPS), at around 850 megahertz (MHz), and the PCS (Personal Communication System) band, at around 1900 MHz, are used. Other communication bands include the PCN (Personal Communication Network) and DCS at approximately 1800 MHz, the GSM system (Groupe Speciale Mobile) at approximately 900 MHz, and the JDC Japanese Digital Cellular) at approximately 800 and 1500 MHz. Other bands of interest are GPS signals at approximately 1575 MHz, Bluetooth at approximately 2400 MHz, and wideband code division multiple access (WCDMA) at 1850 to 2200 MHz.

Wireless communications devices are known to use simple cylindrical coil or whip antennas as either the primary or secondary communication antennas. Inverted-F antennas are also popular. The resonance frequency of an antenna is responsive to its electrical length, which forms a portion of the operating frequency wavelength. The electrical length of a wireless device antenna is often at multiples of a quarter-wavelength such as $5\lambda/4$, $3\lambda/4$, $\lambda/2$, or $\lambda/4$, where $\lambda$ is the wavelength of the operating frequency, and the effective wavelength is responsive to the physical length of the antenna radiator and the proximate dielectric constant.

Many of the above-mentioned conventional wireless telephones use a monopole or single-radiator design with an unbalanced signal feed. This type of design is dependent upon the wireless telephone printed circuit boards groundplane and chassis to act as the counterpoise. A single-radiator design acts to reduce the overall form factor of the antenna. The counterpoise, however, is susceptible to changes in the design and location of proximate circuitry, and interaction with proximate objects when in use, i.e., a nearby wall or the manner in which the telephone is held. As a result of the susceptibility of the counterpoise, the radiation patterns and communications efficiency can be detrimentally impacted.

In addition, many devices require more than one antenna to receive and/or transmit wireless signals at different frequencies. Accordingly, there is need for a multiple band antenna that is less susceptible to RF noise, to interaction with proximate objects and that can be implemented within a small volume.

SUMMARY

A multiple band capacitively-loaded magnetic dipole antenna includes a plurality of magnetic dipole radiators connected to a transformer loop where the magnetic dipole radiators include at least one capacitively-loaded magnetic dipole radiator. The transformer loop has a balanced feed interface and includes a side that provides a transformer interface of quasi loops formed by the plurality of magnetic dipole radiators. Each quasi loop has a configuration and length to maximize antenna performance within a different frequency band. The at least one capacitively-loaded magnetic dipole radiator may be formed with a meander line structure and may include an electric field bridge such as a dielectric gap, lumped element, circuit board surface-mounted, ferroelectric tunable, or a microelectromechanical system (MEMS) capacitor.

BRIEF DESCRIPTION OF THE DRAWINGS

FIG. 14 is an illustration of a top view of a variation of the capacitively-loaded magnetic dipole antenna of FIG. 3.

FIG. 15 is a table comparing the results of a conventional planar invented-F antenna (PIFA) to the capacitively-loaded magnetic dipole antenna of FIG. 14.

FIG. 16 is a plot showing the antenna efficiency and radiating efficiency of the antenna of FIG. 14.

DETAILED DESCRIPTION

Due to a balanced feed, a multiple band capacitively-loaded antenna is less susceptible to noise. Noise present on both feeds is cancelled. Further, the use of balanced circuitry reduces the amount of current circulating in the groundplane, minimizing receiver desensitivity issues. The performance of the multiple band dipole antenna is also less susceptible to proximate objects. In addition, the balanced antenna can be configured within the same space as most unbalanced antennas.

In the exemplary embodiment described below, the antenna includes a plurality of magnetic dipole radiators that form quasi loops with a transformed loop. Each quasi loop is configured to maximize antenna performance within a different frequency band.

The transformer loop has a radiator interface coupled to a quasi loop transformer interface of the multiple quasi loops. In one aspect, the coupled interfaces have a perimeter portion shared by both loops. The plurality of magnetic dipole radiators includes one or more capacitively-loaded magnetic dipole radiators. Further, one or more of the plurality may include meander line radiators. In one configuration, one of the quasi loops includes a first group of substantially parallel lines connected to one end of the shared perimeter, and the second group of substantially parallel lines, orthogonal to the first group of lines, interposed between the first group of lines and one end of a bridge. Also, a quasi loop may include a third group of substantially parallel lines connected to the other end of the shared perimeter, and a fourth group of substantially parallel lines, orthogonal to the third group of lines, interposed between the third group of lines and the other end of the bridge.

Figure 1A:
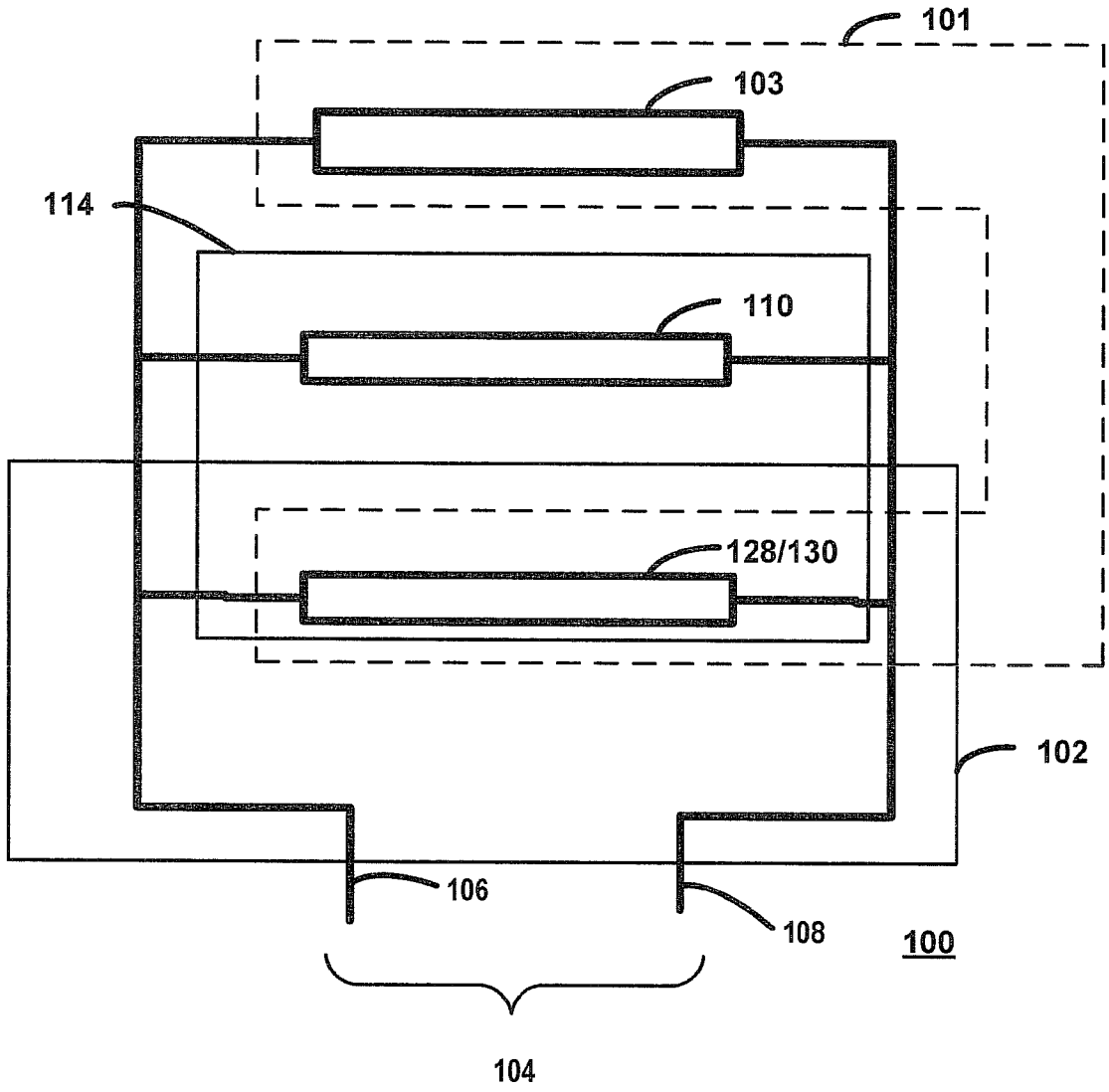
FIG. 1A is a block diagram of a multiple band capacitively-loaded magnetic dipole antenna in accordance with an exemplary embodiment of the invention.

FIG. 1A is a block diagram of a multiple band capacitively-loaded magnetic dipole antenna (antenna) 100 in accordance with the exemplary embodiment. A transformer loop 102 has a balanced feed interface 104 that accepts a positive signal on line 106 and a negative signal (considered with respect to the positive signal) on line 108. In some aspects, the signal on line 108 is 180 degrees out of phase with the signal on line 106. The antenna 100 includes a plurality of quasi loops 101, 114 formed with a plurality of magnetic dipole radiators 103, 110. Although the exemplary embodiment includes two magnetic dipole radiators 103, 110, more than two are used in some circumstances. Each radiator 103, 110 forms a quasi loop 101, 114 with a transformer interface 130 which is coupled to a radiator interface 128 of a transformer loop 102. In the exemplary embodiment, the loop interface 128 coincides with the transformer interface 130 although other coupling methods may be used. Each quasi loop 101, 114 is configured to maximize antenna performance within a different frequency band.

Figure 1B:
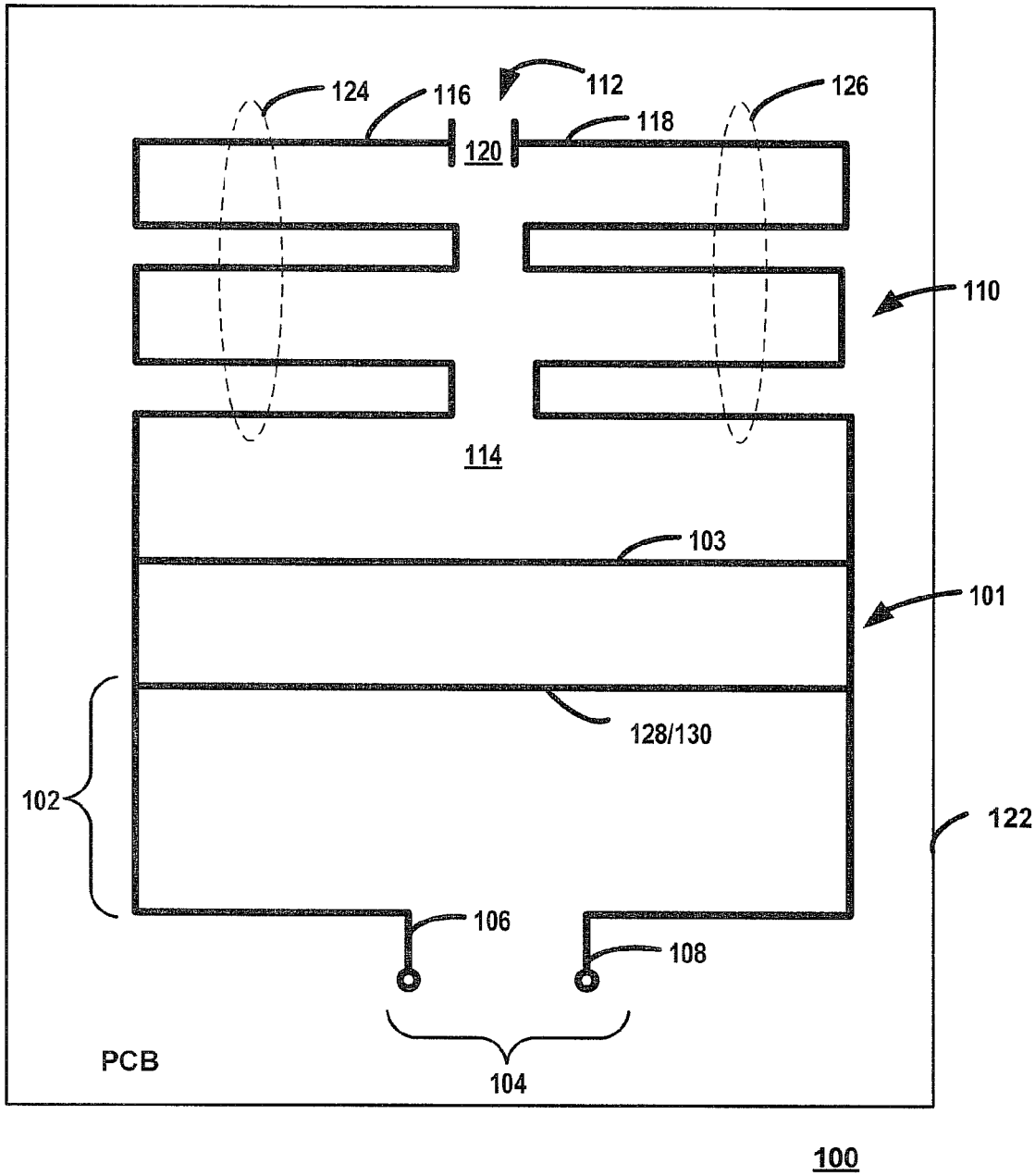
FIG. 1B is a plan view of a meander line capacitively-loaded magnetic dipole antenna.

FIG. 1B is a schematic illustration of a top view of the antenna 100 where the one of the magnetic dipole radiators is a meander line capacitively-loaded magnetic dipole radiator 110. The other magnetic dipole radiator 103 is a solid line conductor that forms a quasi loop 101 with the transformer interface 130. The exemplary meander line capacity-loaded magnetic dipole radiator 110 includes an electric field bridge 112 interposed between a first quasi loop end 116 and a second quasi loop end 118 of the quasi loop 114. The bridge 112 is a dielectric gap capacitor, where the dielectric is the material 120 in the bridge. An example of a suitable dielectric material 120 is air. In some circumstances, the transformer loop 102 and radiator 110 may be conductive microstrip traces on a printer circuit board (PCB) 122, in which case the dielectric material 120 is primarily the PCB dielectric. The bridge 112 acts to confine an electric field. Accordingly, a suitable interpretation of the antenna 100 of FIG. 1B includes understanding the antenna as a confined electric field magnetic dipole antenna. The antenna can be considered as comprising a quasi loop 114 acting as an inductive element, and a bridge 112 that confines an electric field between the quasi loop first and second end sections 116,118. The magnetic dipole radiator 110 can be a balanced radiator, or quasi-balanced. Unlike conventional dipole antennas, which operate by generating an electric field (E-field) between radiators, a capacitively-loaded magnetic dipole operates by generating a magnetic field (H-field) through the quasi loop 114. The bridge 112, or confined electric field section, couples or conducts substantially all the electric field between first and second end sections 116,118. As used herein, "confining the electric field" means that the near-field radiated by the antenna is mostly magnetic. Thus, the magnetic field that is generated has less of an interaction with the surroundings or proximate objects. The reduced interaction can positively impact the overall antenna efficiency.

For the exemplary meander line shown in FIG. 1B, the quasi loop 114 comprises a first group of substantially parallel meander lines 124 (identified by a dashed ellipse) and a second group of substantially parallel meander lines 126 (identified by another dashed ellipse). The lines are considered to be substantially parallel if the majority of the overall line length is formed as parallel running lines. As shown, the first group of meander lines 124 is orthogonal to the second group of meander lines 126. The lines in the first group 124 (or second group 126) need not be parallel. Further, the relationship between the first group 124 and second group 126 need not be orthogonal.

As discussed above, the transformer loop 102 has a radiator interface 128 and the quasi loop 114 has a transformer interface 130 coupled to the transformer loop radiator interface 128. As shown in FIG. 1B, the interface 128 is a first side of the transformer loop 102, and the quasi loop 114 has a perimeter that shares the first side 128 with the transformer loop 102. The interfaces 128 and 130, therefore, are a shared perimeter portion from both the transformer loop 112 and the quasi loop 114. Other suitable techniques may be used to couple the transformer loop 102 to the quasi loop 114.

In the interest of clarity, the exemplary embodiment will be described in the context of rectangular-shaped loops. However, the transformer loop 102 and quasi loop 114 are not limited to any particular shape. Examples of other suitable loop shapes include, but are not limited to, circular and oval shapes as well as configurations using multiple straight sections such a polygon. Further, the transformer loop 102 and quasi loop 114 may have different shapes in some circumstances. Even if the transformer loop 102 and the quasi loop 110 are formed in substantially the same shape, the perimeters or areas surrounded by the perimeters need not necessarily be the same.

As discussed above, each of the quasi loops 101, 114 is configured to maximize antenna performance within a different frequency band. For the example shown in FIG. 1B, the meander line radiator 110 forms a quasi loop 114 that is configured to maximize performance within a frequency band lower than the frequency band of the quasi loop 101 formed with the shorter magnetic dipole radiator 103.

Figure 1C:
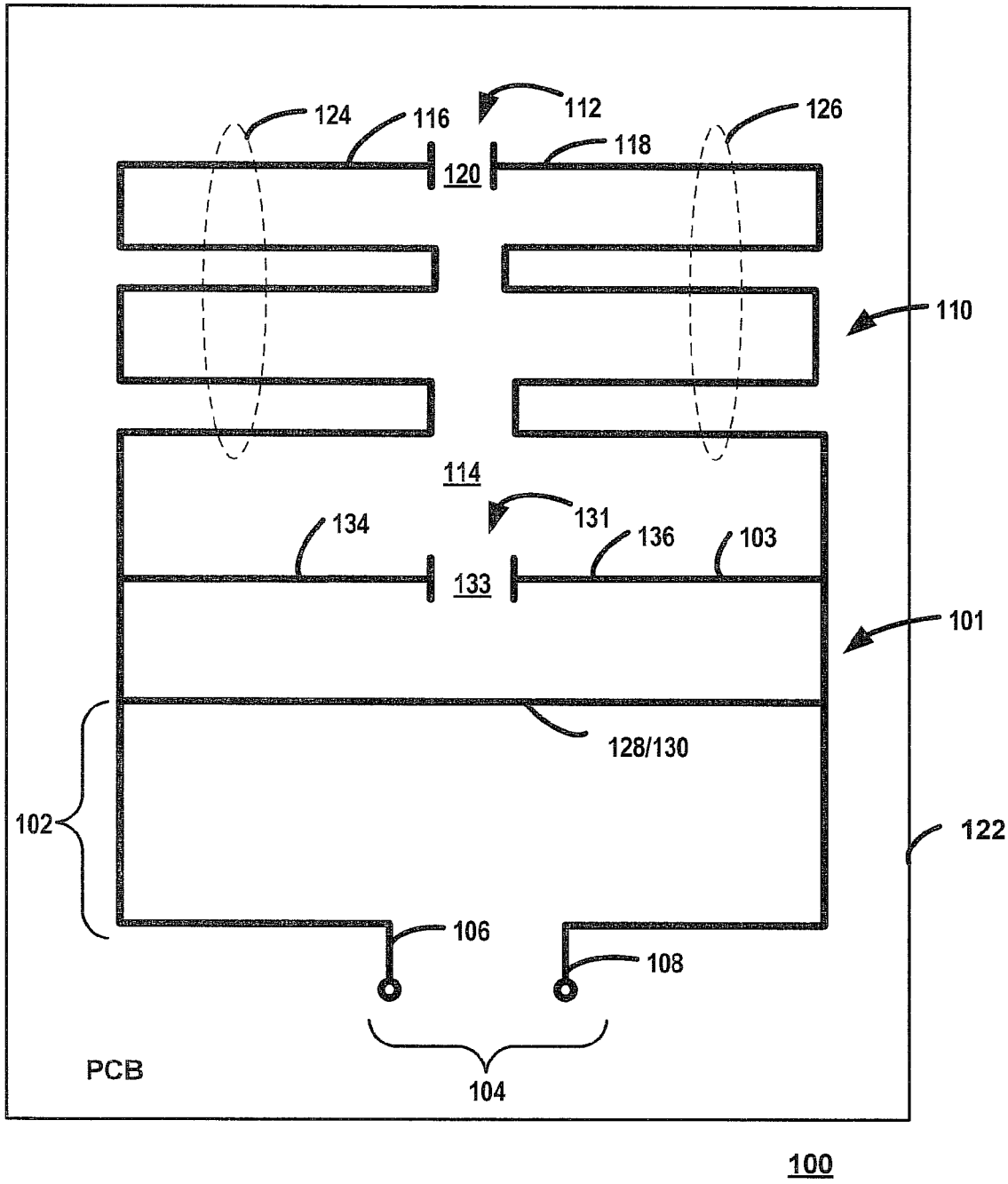
FIG. 1C is a schematic illustration of a top view of the antenna where one of the magnetic dipole radiators is a meander line capacitively-loaded magnetic dipole radiator and the other is a capacitively-loaded magnetic dipole radiator.

FIG. 1C is a schematic illustration of a top view of the antenna 100 where one of the magnetic dipole radiators is a meander line capacitively-loaded magnetic dipole radiator 110 and the other is a capacitively-loaded magnetic dipole radiator 103. For the example discussed with reference to FIG. 1C, the magnetic dipole radiator 103 includes a bridge 131 between a quasi loop first end 134 and a quasi loop second end 136. The quasi loop 101 acting as an inductive element, and the bridge 131 that confines an electric field between the quasi loop first and second end sections 134, 136. The bridge 131 is a dielectric gap capacitor, where the dielectric is the material 133 in the bridge. An example of a suitable dielectric material 133 is air. Although the dielectric material 133 is the same as the dielectric material 120 in the bridge of the meander line radiator 110, the dielectrics can be different in some circumstances.

Other configurations of capacitively-loaded and non-capacitively-loaded magnetic dipole radiators may be used to form the multiple band antenna 100. For example, the bridge 112 may be omitted from the meander line radiator 110 in some situations. Such an example is shown in FIG. 1D.

Figure 1D:
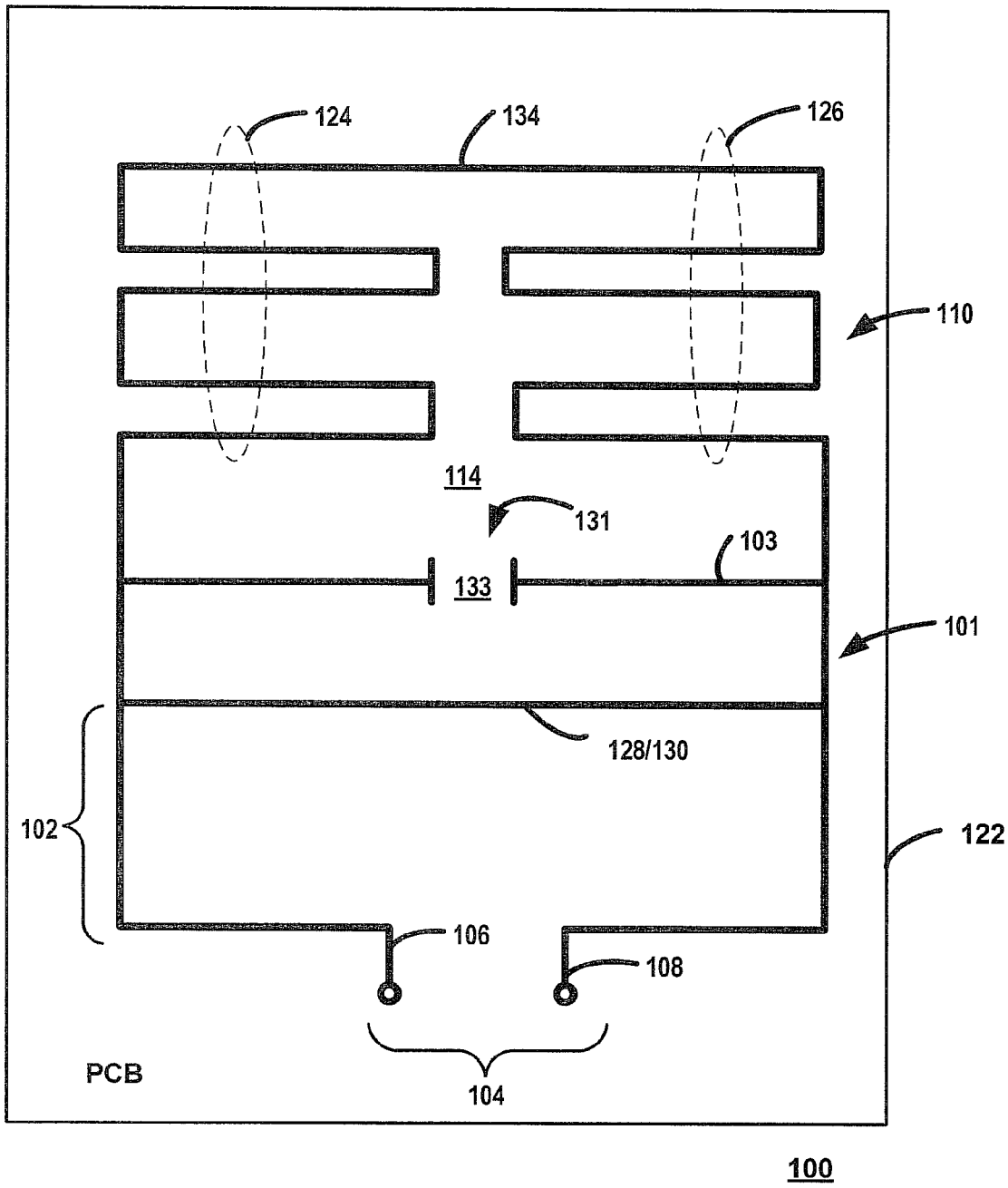
FIG. 1D is a schematic illustration of a top view of the antenna where one of the magnetic dipole radiators is a meander line magnetic dipole radiator and the other is a capacitively-loaded magnetic dipole radiator.

FIG. 1D is a schematic illustration of a top view of the antenna 100 where one of the magnetic dipole radiators is a meander line magnetic dipole radiator 134 and the other is a capacitively-loaded magnetic dipole radiator 103 where the magnetic dipole radiator 134 does not include a bridge.

Figure 2A:
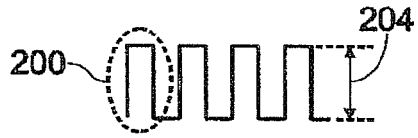
FIGS. 2A through 2E are schematic illustrations of different meander line variations.

FIGS. 2A through 2E are schematic illustrations of top views of meander line variations. As shown in FIG. 2A, the quasi loop meander line may comprise a plurality of sections having a shape 200, a pitch 202, a height, 204, and an offset 206. As shown in FIG. 2A, the shape 200 is rectangular, the pitch is equal (there is no pitch), the height 204 is equal (uniform), and there is no offset.

Figure 2B:
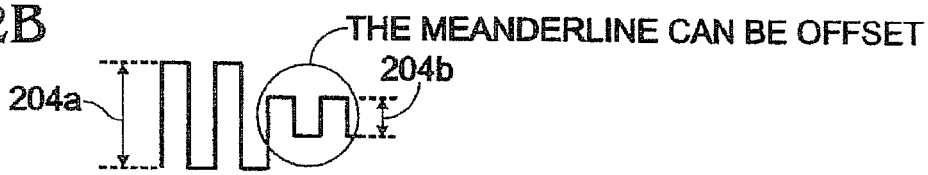

FIG. 2B shows a meander line with a rectangular shape, an equal pitch, an unequal heights 204*a* and 204*b*, with no offset.

Figure 2C:
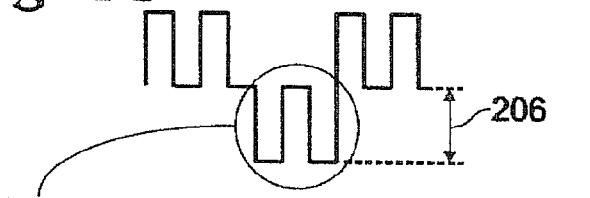

FIG. 2C shows a meander line with a rectangular shape, an equal pitch, an equal height, with an offset 206.

Figure 2D:
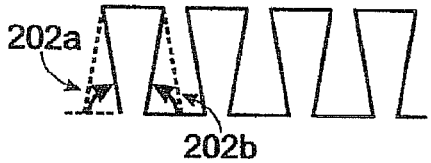

FIG. 2D shows a meander line with a zig-zag shape, a pitch 202*a* and 202*b*, an equal height, with no offset.

Figure 2E:
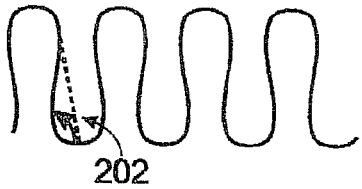

FIG. 2E shows a meander line with a round shape, a pitch 202, an equal height, with no offset.

As is well understood in the art, meander line radiators are an effective way of forming a relatively long effective electrical quarter-wavelength, for relatively low frequencies. The summation of all the sections contributes to the overall length of the meandering line. The meander line described herein in snot necessarily limited to any particular shape, pattern, pitch, height, offset, or length.

Figure 3:
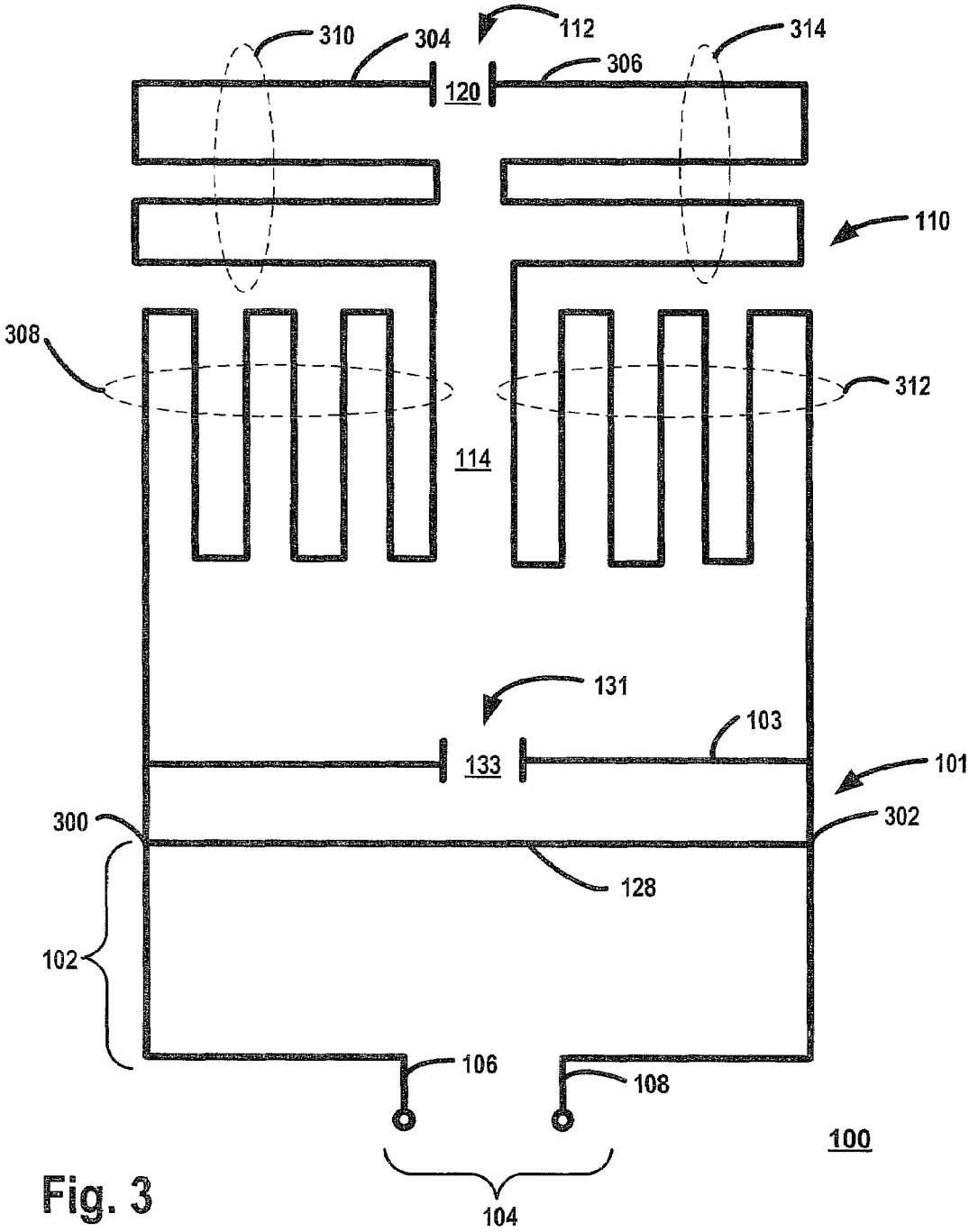
FIG. 3 is schematic illustration of a first variation of the capacitively-loaded magnetic dipole antenna of FIG. 1B.

FIG. 3 is schematic illustration of a first variation of the capacitively-loaded magnetic dipole antenna 100 of FIG. 1B. Transformer loop first side 128 has a first end 300 and second end 302 and the electric field bridge 112 has a first end 304 and a second end 306. The quasi loop 114 has the first group of substantially parallel lines 308 connected to the first end 300 of the first side 128, and the second group of substantially parallel lines 310, about orthogonal to the first group of lines 308. The second group of lines 310 is interposed between the first group of lines 308 and the bridge first end 304.

The quasi loop 114 has a third group of substantially parallel lines 312 connected to the second end 302 of the first side 128. A fourth group of substantially parallel lines 314, about orthogonal to the third group of lines 312, is interposed between the third group of lines 312 and the bridge second end 306. As shown, the quasi loop third group of lines 312 is about parallel to the first group of lines 308, and the fourth group of lines 314 is about parallel to the second group of lines 310. However, other relationships can be formed between the third group of lines 312 and the first group of lines 308, as well as between the fourth group of lines 314 and the second group of lines 310.

In another aspect, the meander line capacitively-loaded magnetic dipole radiator 110 resonates at a first frequency and at a second frequency, non-harmonically related to the first frequency. The ability of the antenna 100 to resonant at two non-harmonically related frequency is a result of the placement of the first (third) group of lines 308 with respect to the second (fourth) group 310.

Figure 4A:
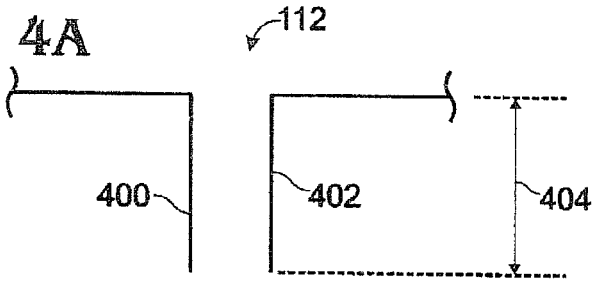
FIGS. 4A through 4E depict alternate variations of an electric field bridge.

FIGS. 4A through 4E depict alternate variations of an electric field bridge. In FIG. 4A, the bridge 112 is shown as a dielectric gap capacitor. Here, the bridge first end section 400 is about parallel to a second end section 402, and equal in length 404. However, other arrangements are possible between the bridge first end 400 and bridge second end 402. The bridge 112 may be an interdigital gap capacitor in some circumstances.

Figure 4B:
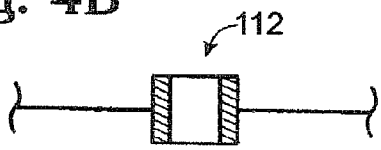
Figure 4C:
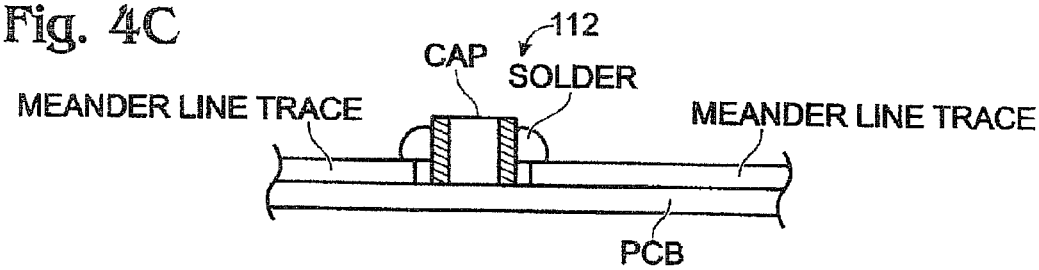
Figure 4D:
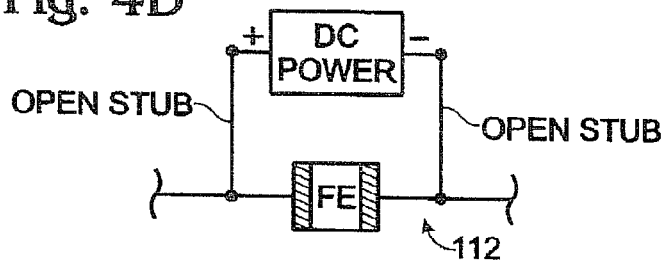
Figure 4E:
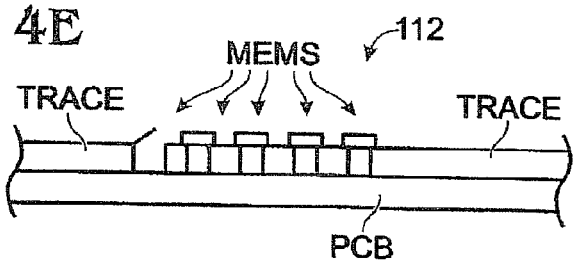

In FIG. 4B, the bridge 112 is shown as a lumped element capacitor. In FIG. 4C, the bridge 112 is shown as a surface-mounted capacitor. In FIG. 4D, the bridge is shown as a ferroelectric (FE) tunable capacitor. In FIG. 4E, the bridge is shown as a microelectromechanical system (MEMS) dielectric gap capacitor formed from selectively connected conductive sections, to create gaps of different sizes.

Figure 5:
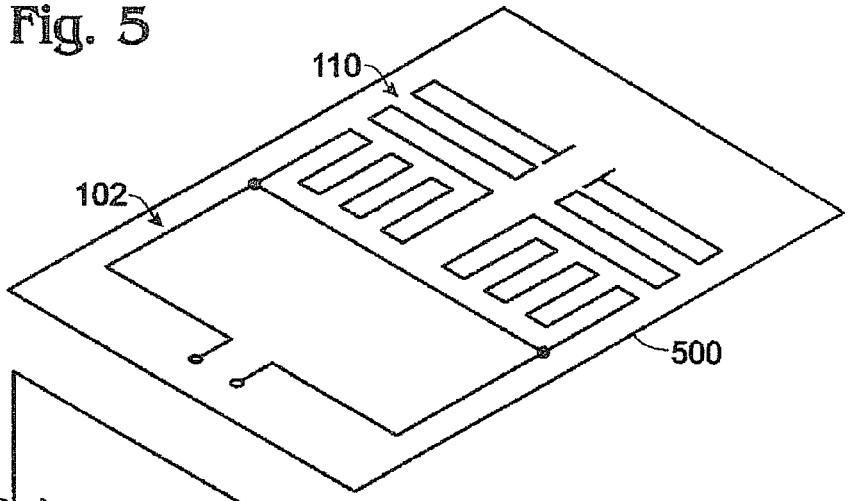
FIG. 5 is an illustration of a perspective view of a coplanar version of the antenna of FIG. 1B.

FIG. 5 is an illustration of a perspective view of a coplanar version of the antenna 100 of FIG. 1B. As shown, the transformer loop 102 and the meander line capacitively-loaded magnetic dipole radiator 110 are coplanar. That is, the transformer loop 102 and the capacitively-loaded magnetic dipole radiator 110 are in the same plane 500. However, as described below, other planar arrangements are possible.

Figure 6:
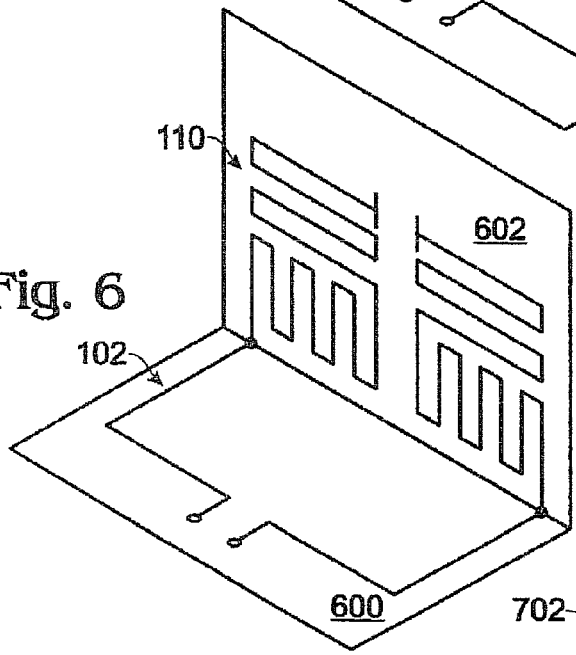
FIG. 6 is an illustration of a perspective view of a non-coplanar variation of the antenna of FIG. 1B.

FIG. 6 is an illustration of a perspective view of a non-coplanar variation of the antenna of FIG. 1B. In the interest of brevity and clarity, only a single radiator 110 is shown in FIG. 6. Any number of additional magnetic dipole radiators 103 may be included in the antenna 100. In this example, the transformer loop 102 and the meander line capacity-loaded magnetic dipole radiator 110 are non-coplanar. That is, the transformer loop 102 is in a first plane 600 and the capacitively-loaded magnetic dipole 110 is in a second plane 602. As shown, the first plane 600 is about orthogonal to the second plane 602. However, other planar relationships are possible.

Figure 7:
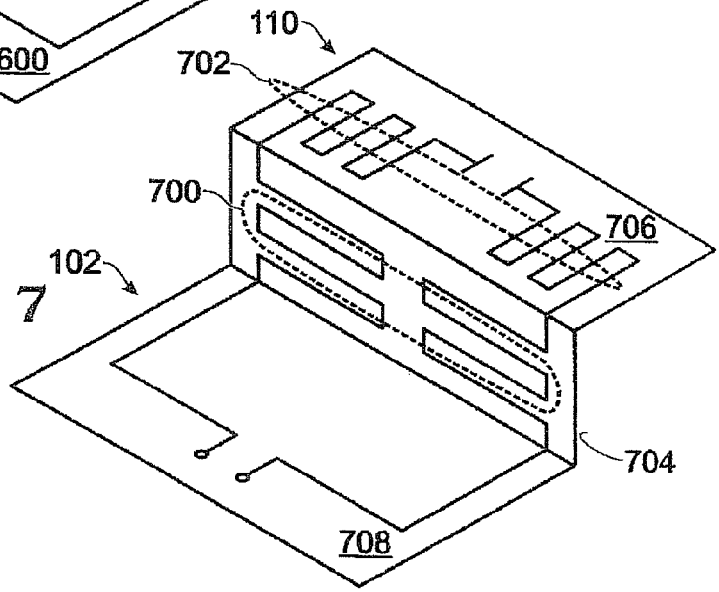
FIG. 7 is an illustration of a perspective view of a variation of the antenna of FIG. 3.

FIG. 7 is an illustration of a perspective view of a variation of the antenna of FIG. 3. In the interest of brevity and clarity, only a single radiator 110 is shown in FIG. 7. Any number of additional magnetic dipole radiators 103 may be included in the antenna 100. Not only may the transformer loop 102 and magnetic dipole radiator 110 be in different planes (see FIG. 6), the capacitively-loaded magnetic dipole radiator 110 (or the transformer loop 102) may be comprised on non-coplanar sections. As shown in FIG. 7, a quasi loop first group of lines 700, in plane 704, is non-coplanar with a second group of lines 702, in plane 706. The transformer loop 102 is in plane 708. Again, the two planes 706 and 708 are shown as about orthogonal, however, other planar relationships are possible. Although not shown, the transformer loop may also be formed in non-coplanar sections.

Further, the capacitively-loaded magnetic dipole radiator 110 may be formed in a plurality of planar sections (not shown). Further, each planar sections may be curved, bowed, or shaped. In summary, it should be understood that the antenna is not confined to any particular shape, but may be conformed to fit on or in an object, such as a cellular telephone housing.

Figure 8:
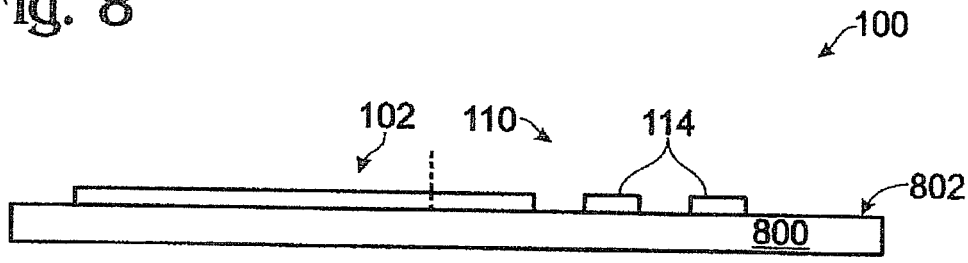
FIG. 8 is an illustration of a partial cross-sectional view depicting a microstrip variation of the antenna of FIG. 1B.

FIG. 8 is an illustration of a partial cross-sectional view depicting a microstrip variation of the antenna of FIG. 1. The antenna further comprises a sheet of dielectric material 800 with a surface 802. The transformer loop 102 and meander line capacitively-loaded quasi loop 114 are metal conductive traces (i.e., 0.5 ounce copper, silver, conductive ink, or tin) formed overlying the surface 802 of the dielectric sheet 800. The dielectric sheet 800 can be a material such as paper, polyester, polyimide, synthetic aromatic polyamide polymer, phenolic, polytetrafluoroethylene (PTFE), chlorosulfonated polyethylene, silicon, or ethylene propylene diene monomer (EPDM). In addition, the dielectric sheet may be any conventional PCB material, such as FR4 or higher dielectric materials conventionally used in radio frequency (RF) circuit boards.

Figure 9:
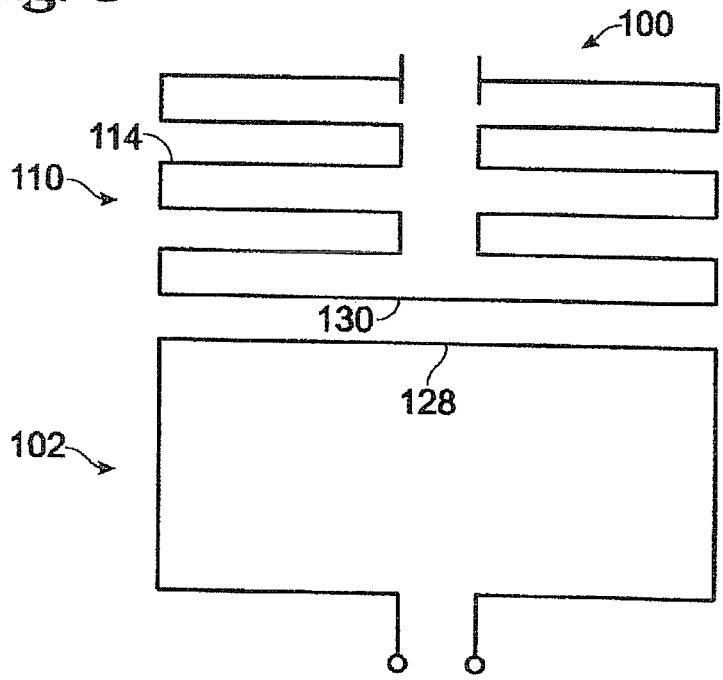
FIG. 9 is an illustration of a plan view of a physically independent loop variation of the antenna of FIG. 1B.

FIG. 9 is an illustration of a top view of a physically independent loop variation of the antenna of FIG. 1B. In the interest of brevity and clarity, only a single radiator 110 is shown in FIG. 9. Any number of additional magnetic dipole radiators 103 may be included in the antenna 100. In this variation, the transformer loop 102 and capacitively-loaded magnetic dipole radiator 110 are not physically connected. Alternately stated, the transformer loop 102 and quasi loop 114 do not share any electrical current, as interfaces 128 and 130 do not touch. As shown, the transformer loop 102 perimeter is physically independent of the quasi loop 114 perimeter.

Figure 10:
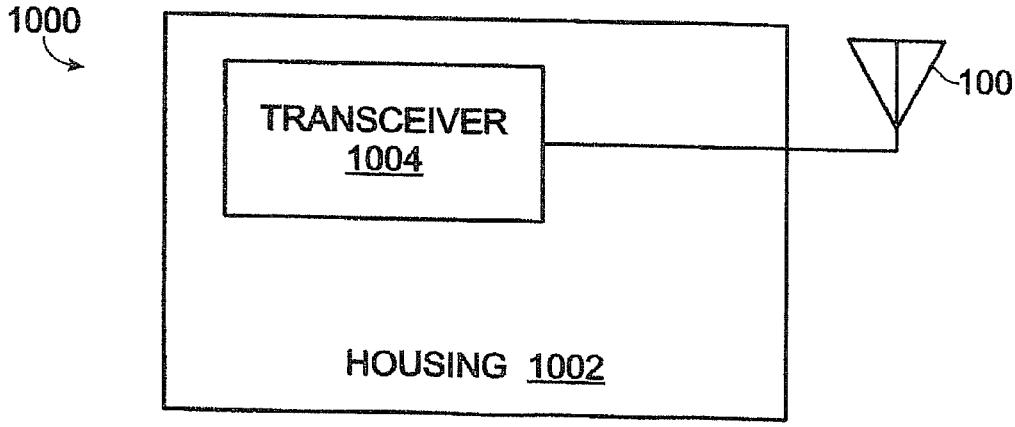
FIG. 10 is a schematic block diagram of a wireless telephone communications device capacitively-loaded magnetic dipole antenna.

FIG. 10 is a schematic block diagram of a wireless telephone communications device capacitively-loaded magnetic dipole antenna. The device 1000 comprises a housing 1002 and a telephone transceiver 1004 embedded in the housing 1002. A balanced feed meander line capacitively-loaded magnetic dipole antenna 100 is embedded in the housing 1002. As explained in more detail below, the capacitively-loaded magnetic dipole antenna 100 has a radiation efficiency that is insensitive to the proximity of the placement of a user's hand on the housing 1002.

The invention is not limited to any particular communication format, i.e., the format may be Code Division Multiple Access (CDMA), Global System for Mobile Communications (GSM), or Universal Mobile Telecommunications System (UMTS). Neither is the device 1000 limited to any particular range of frequencies. Details of the antenna 100 are provided in the explanations of FIGS. 1 through 9, above, and will not be repeated in the interests of brevity. Note, the invention is also applicable to other portable wireless devices, such as two-way radios, GPS receivers, Wireless Local Area Network (WLAN) transceivers, to name a few of examples.

Figure 11:
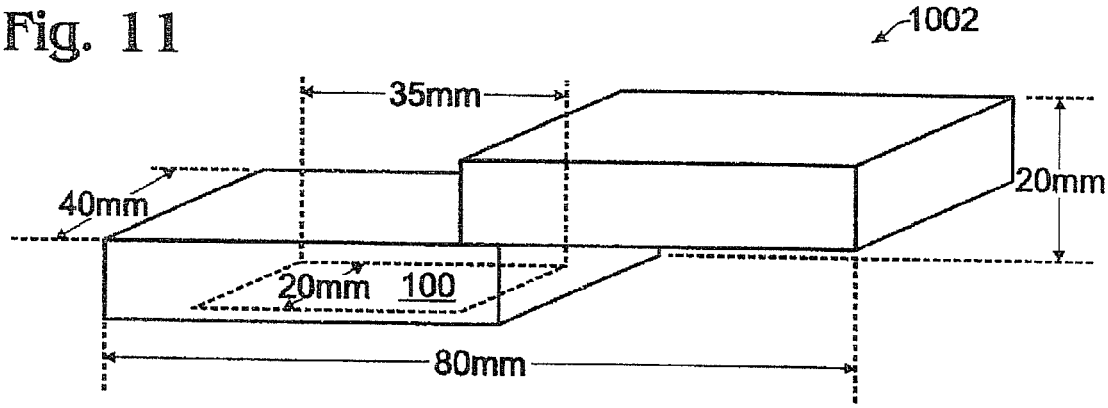
FIG. 11 is an illustration of a first perspective view of the wireless device of FIG. 10.

FIG. 11 is an illustration of a first perspective view of the wireless device of FIG. 10. In this aspect, the housing is a two-part configuration such as a flip, slider, or swivel cellular telephone. In either the open or closed configuration, the above-mentioned housings all share about the same form factor, with the difference being in the hinge/opening mechanism. In the open configuration (as shown) the housing has the dimensions of about 40 by 80 by 20 millimeters (mm), or greater. The antenna 100, shown in phantom) has dimensions of about 35 mm by 20 mm by 0.05 micrometers, or greater.

Figure 12:
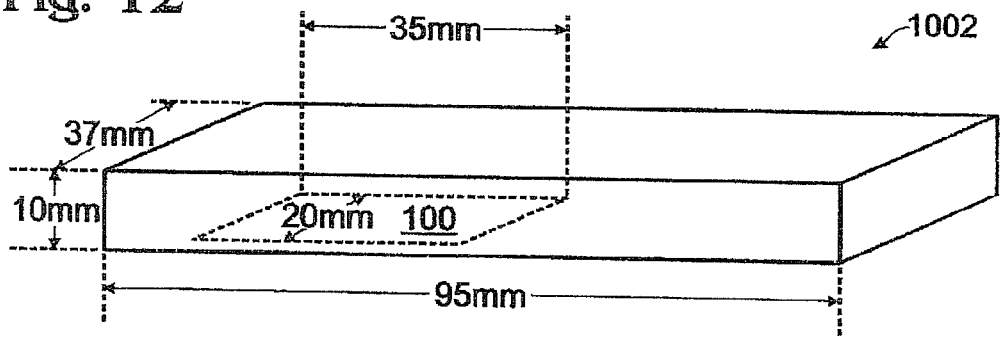
FIG. 12 is an illustration of a second perspective view of the wireless device of FIG. 10.

FIG. 12 is an illustration of a second perspective view of the wireless device of FIG. 10. In this aspect, the housing 1002 is a "candy bar" cellular telephone with dimensions of about 95 by 37 by 10 mm, or greater. Again, the antenna 100 has dimensions of about 35 mm by 20 mm by 0.05 micrometers, or greater.

Functional Description

Balanced antennas do not make use of the ground plane in order to radiate. This means that a balanced antenna can be located in a very thin wireless device, without detrimental affecting radiation performance. In fact, the antenna can be located within about 2 to 3 mm of a groundplane with no noticeable effect upon performance. The antenna is also less sensitive to currents on the ground plane, such as noise currents, or currents that are related to Specific Absorption Rate (SAR). Since the antenna can be made coplanar, it can be realized on a flex film, for example, at a very low cost.

Figure 13:
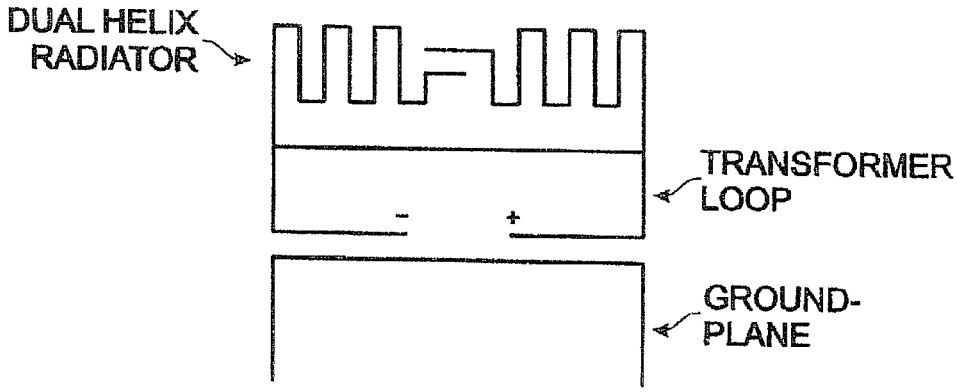
FIG. 13 is an illustration of a top view of a dual helix variation of the antenna of FIG. 1.

FIG. 13 is a plan view of a dual helix variation of the antenna of FIG. 1B. As in FIG. 1B, the radiator quasi loop may be matched to low impedances with the addition of a transformer loop. In the interest of brevity and clarity, only a single radiator 110 is shown in FIG. 13. Any number of additional magnetic dipole radiators 103 may be included in the antenna 100.

FIG. 14 is an illustration of a top view of a variation of the capacitively-loaded magnetic dipole antenna of FIG. 3. The antenna's transformer loop is matched into a balun built from lump elements (12 nH and 3 pF). Without the balun, the antenna efficient is measured to be about 45% efficient. With the balun, the same antenna is about 70% efficient at the radiating frequency.

FIG. 15 is a table comparing the results of a conventional planar invented-F antenna (PIFA) to the capacitively-loaded magnetic dipole antenna of FIG. 14. The results are measured at while transmitted at approximately 824 MHz. The results show that while the capacitively-loaded magnetic dipole antenna performs slightly poorer in free space (0.6 dB), it outperforms the PIFA by 2.6 db in the proximity of a phantom head, and 3.1 db in proximity to a phantom hand. If fact, it is significant that no change in the performance of the capacitively-loaded magnetic dipole can be measured while simulating the effects of a user's hand.

FIG. 16 is a plot showing the antenna efficiency and radiating efficiency of the antenna 100 for the single radiator antenna of FIG. 14. Antenna efficiency includes all types of loss, including voltage standing wave ratio (VSWR) and loss in material. Radiation efficiency corresponds to the efficiency of a perfectly matched antenna.

Figure 17:
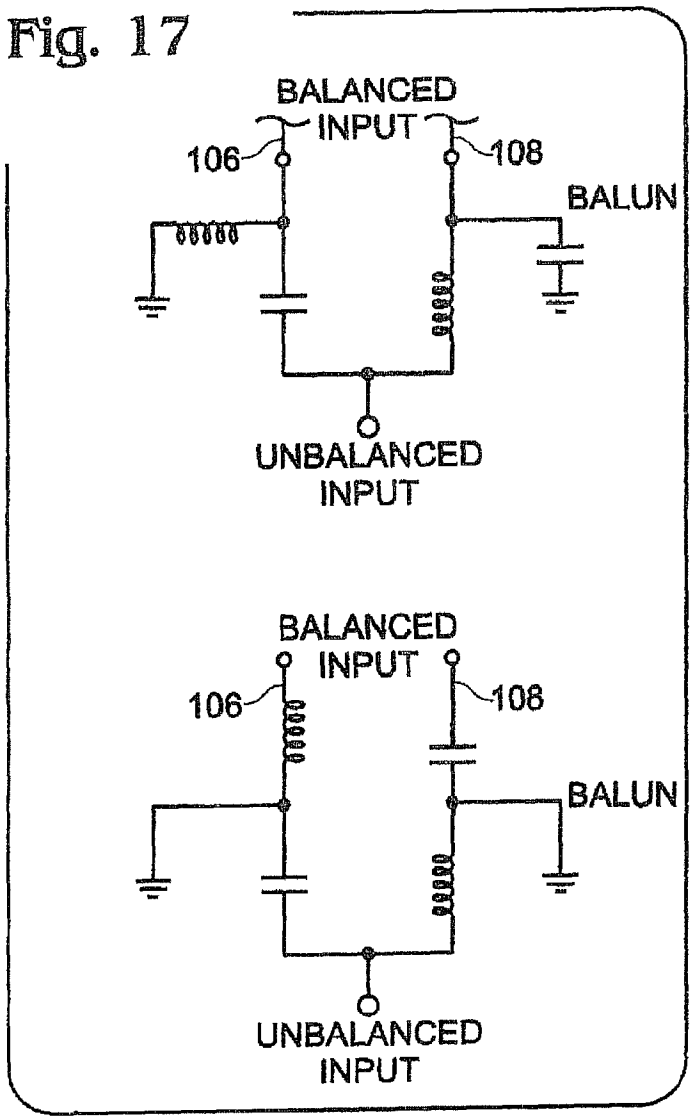
FIG. 17 is a schematic diagram depicting two different balun configurations that can be used to supply a balanced feed input to the transformer loop of the capacitively-loaded magnetic dipole antenna.

FIG. 17 is a schematic diagram depicting two different balun configurations that can be used to supply a balanced feed to the transformer loop inputs 106 and 108 of the capacitively-loaded magnetic dipole antenna, from an unbalanced feed such as a coaxial cable. The balun component values are selected based on operating parameters such as impedance and operating frequencies. In some circumstances, the transformer loop inputs 106, 108 comprise components with the same values. In some situations, however, the component values may differ between the two inputs 106, 108 to form a 'quasi-balun". Further, in some circumstances, the one inputs 106 may include a different number of components that the other input 108 to improve the impedance match at the operating frequencies. For example, a capacitor in one of the inputs 106 may be omitted and replaced with a short circuit.

Figure 18:
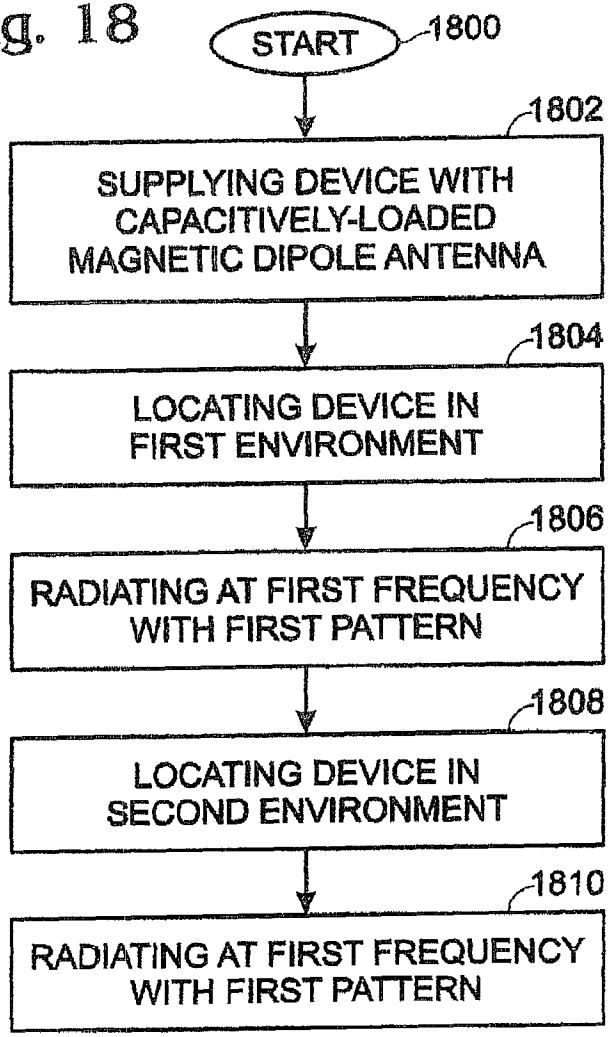
FIG. 18 is a flowchart illustrating the present invention magnetic radiation method that is insensitive to changes in a proximately located dielectric.

FIG. 18 is a flowchart illustrating the present invention magnetic radiation method that is insensitive to changes in a proximately located dielectric. Although the method is depicted as a sequence of numbered steps for clarity, no order need be inferred from the numbering. It should be understood that some of these steps may be skipped, performed in parallel, or performed without the requirement of maintaining a strict order of sequence. The method starts at Step 1800.

Step 1802 supplies a wireless communications device with a meander line capacitively-loaded magnetic dipole antenna. Step 1804 locates the device in a first environment with a first dielectric constant. Step 1806 radiates at a first frequency with a first radiation pattern in the first environment. Step 1808 locates the device in a second environment with a second dielectric constant, different than the first dielectric constant. Step 1810 continues to radiate at the first frequency with the first radiation pattern in the second environment.

In one aspect, supplying the wireless communications device with the capacitively-loaded magnetic dipole antenna in Step 1802 includes supplying a cellular telephone (see FIG. 10), and radiating at the first frequency (Step 1806) includes radiating at a frequency of about 800 MHz. Locating the device in the first environment in Step 1804 includes locating the cellular telephone in free space, while locating the device in the second environment (Step 1808) includes contacting the cellular telephone with a human hand. Then, continuing to radiate at the first frequency with the first radiation pattern in Step 1810 includes radiating the first radiation pattern with about a 0 dB loss in the hand-proximate environment, as compared to the free space environment.

Figure 19:
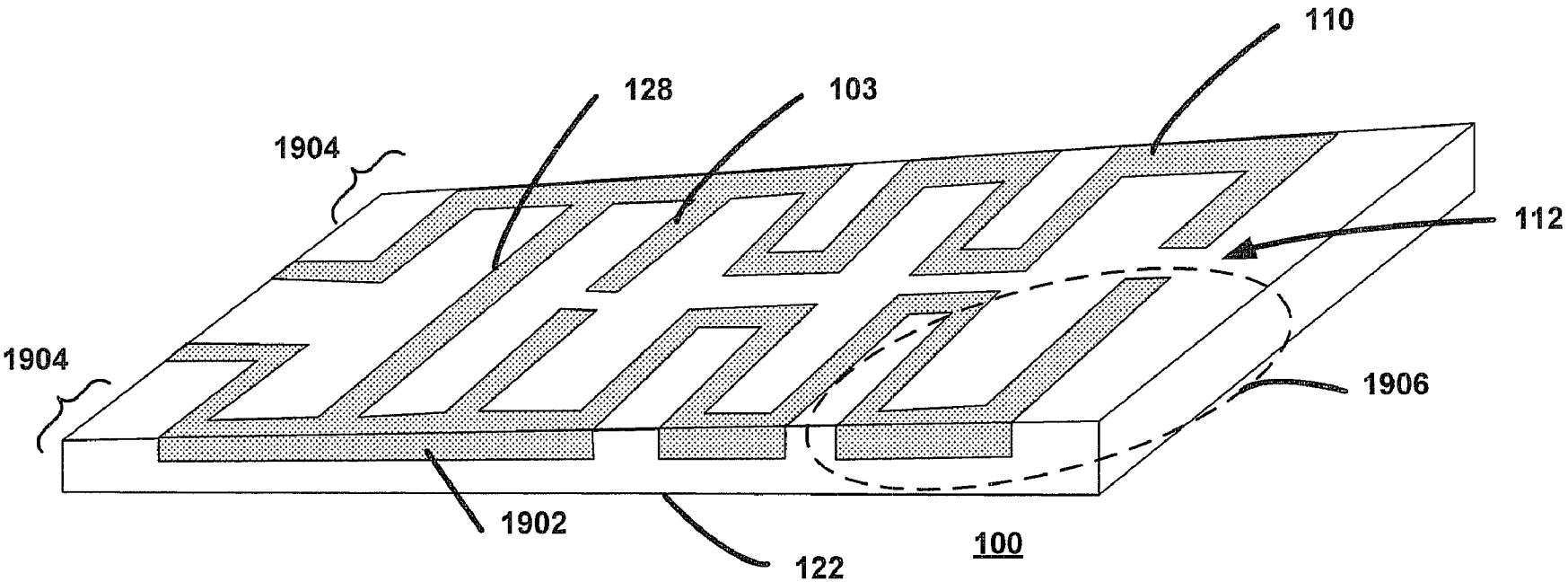
FIG. 19 is an illustration of a perspective view of the exemplary multiple band capacitively-loaded loop antenna where the peripheral section of the radiators include angled edge portions.
Figure 20:
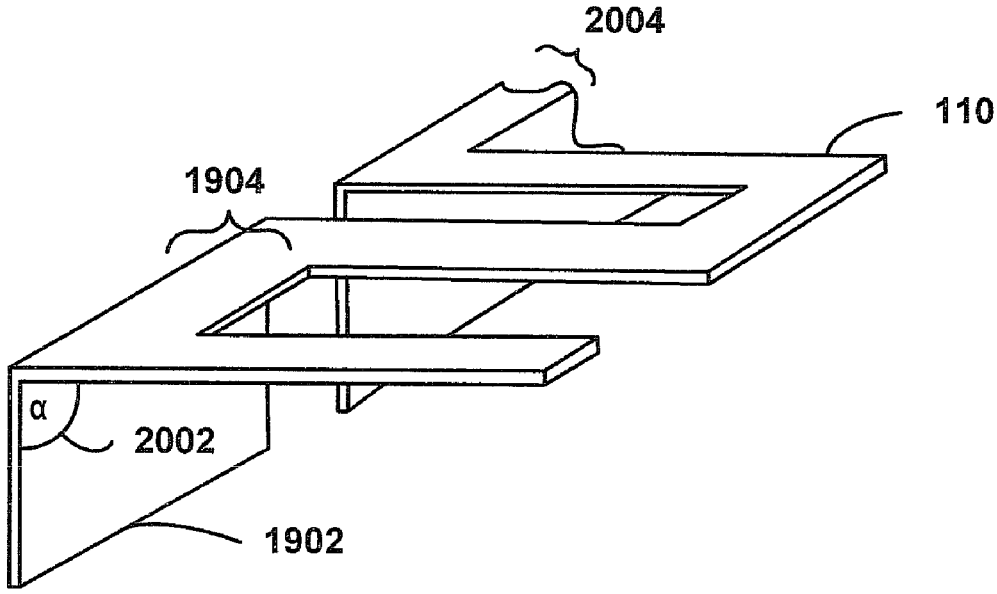
FIG. 20 is an illustration of a perspective view of a portion of the antenna shown within the area indicated in FIG. 19 with a dashed line oval.

FIG. 19 is an illustration of a perspective view of the exemplary multiple band capacitively-loaded loop antenna 100 where the peripheral section of the radiators include angled edge portions 1902. The illustrations in FIG. 19 and FIG. 20 are not necessarily to scale and are intended to provide general relative positions of the various components of the exemplary antenna 100. The antenna 100 is implemented with an arrangement of conductive traces over a PCB 122. For the example discussed with reference to FIG. 19 and FIG. 20, the peripheral sections of the radiators 103, 110 include angle edge portions 1902 that are perpendicular to the plane of the radiators 103, 110. The angle edge portions 1902, however, may be disposed in any plane other than the plane of the radiators 103, 110. In the example, each peripheral section 1904 of the transformer loop and the quasi loops includes an angled edge portion 1902 that forms a right angle with the other portion of the peripheral section 1904. The peripheral sections 1904 are the portions of the radiators and loop that are at the further most edge of the antenna layout. In some circumstances, only some of the peripheral sections include angled edge portions 1902.

FIG. 20 is an illustration of a perspective view of a portion of the antenna 100 shown within the area 1906 indicated in FIG. 19 with a dashed line oval. In the interest of clarity, the PCB 122 is omitted in FIG. 20. Therefore, FIG. 20 is an illustration of a perspective view of the section of the conductive traces of the antenna 100 within the dashed oval area 1906 of FIG. 19. As explained above, the angled edge portion 1902 of the peripheral section 1904 is perpendicular to the other portion 2004 of the peripheral section 1904. The angle ($\alpha$) 2002 is 90 degrees in the exemplary embodiment. Other angles 2002, however, may be used in some circumstances. The angle ($\alpha$) 2002, for example may be between 45 and 135 degrees in some circumstances. The angled edges provide extra surface area to implement the antenna (radiator), where space is limited.

Therefore, a multiple band antenna 100 with a balanced feed 104 includes a plurality of magnetic dipole radiators 103, 110 each forming a quasi loop 101, 114 with a transformer loop 102. Each quasi loop 101, 114 is configured to maximize antenna performance within a different frequency band. In some circumstances, one or more of the magnetic dipole radiators is capacitively-loaded magnetic dipole radiator. Further, on or more of the magnetic dipole radiators may be a meander line capacitively-loaded magnetic dipole radiator. Some specific examples of loop shapes, loop orientations, bridge and electric field confining sections, physical implementations, and uses have been discussed above. The invention, however, is defined by the claims below and is not to be limited to any one of these specific limitations. Other variations and embodiments of the invention will occur to those skilled in the art.

What is claimed is:

1. A multiple band capacitively-loaded magnetic dipole antenna comprising:

a transformer loop having a balanced feed interface;

a plurality of magnetic dipole radiators connected to the transformer loop and comprising at least one capacitively-loaded magnetic dipole radiator.

2. The antenna of claim 1, wherein the plurality of magnetic dipole radiators comprises a meander line magnetic dipole radiator.

3. The antenna of claim 2, wherein the meander line magnetic dipole radiator is a capacitively-loaded magnetic dipole radiator.

4. The antenna of claim 3 wherein the meander line capacitively-loaded magnetic dipole radiator comprises an electric field bridge.

5. The antenna of claim 4 wherein the meander line capacitively-loaded magnetic dipole radiator comprises a quasi loop with a first end and a second end, wherein the electric field bridge is interposed between the quasi loop first and second ends.

6. The antenna of claim 5 wherein the quasi loop comprises:

a first group of substantially parallel meander lines; and, a second group of substantially parallel meander lines.

7. The antenna of claim 6 wherein the first group of meander lines is orthogonal to the second group of meander lines.

8. The antenna of claim 5 wherein the transformer loop has a radiator interface and the quasi loop has a transformer interface coupled to the transformer loop radiator interface.

9. The antenna of claim 8 wherein the transformer loop has a first side; and the quasi loop has a perimeter that shares the first side with the transformer loop.

10. The antenna of claim 9 wherein the transformer loop first side has a first end and second end;

wherein the electric field bridge has a first end and a second end;

wherein the quasi loop has a first group of substantially parallel lines connected to the first end of the first side, and a second group of substantially parallel lines, about orthogonal to the first group of lines, interposed between the first group of lines and the bridge first end; and, wherein the quasi loop has a third group of substantially parallel lines connected to the second end of the first side, and a fourth group of substantially parallel lines, about orthogonal to the third group of lines, interposed between the third group of lines and the bridge second end.

11. The antenna of claim 10 wherein the quasi loop third group of lines is about parallel to the first group of lines, and the fourth group of lines is about parallel to the second group of lines.

12. The antenna of claim 5 wherein the electric field bridge is an element selected from the group consisting of a dielectric gap, lumped element, circuit board surface-mounted, ferroelectric tunable, and a microelectromechanical system (MEMS) capacitor.

13. The antenna of claim 5 wherein the electric field bridge is a dielectric gap capacitor with a first end section about parallel to a second end section.

14. The antenna of claim 1 wherein the plurality of magnetic dipole radiators comprise:

a linear capacitively-loaded magnetic dipole radiator forming a first quasi loop with a radiator interface of the transformer loop; and a meander line capacitively-loaded magnetic dipole radiator forming a second quasi loop with the radiator interface.

15. The antenna of claim 1 wherein the plurality of magnetic dipole radiators comprise:

a linear non-capacitively-loaded magnetic dipole radiator forming a first quasi loop with a radiator interface of the transformer loop; and a meander line capacitively-loaded magnetic dipole radiator forming a second quasi loop with the radiator interface.

16. The antenna of claim 1 wherein the plurality of magnetic dipole radiators comprise:

a linear capacitively-loaded magnetic dipole radiator forming a first quasi loop with a radiator interface of the transformer loop; and a meander line non-capacitively-loaded magnetic dipole radiator forming a second quasi loop with the radiator interface.

17. A dual band capacitively-loaded magnetic dipole antenna comprising:

a transformer loop having a balanced feed interface and radiator interface;

a linear magnetic dipole radiator connected to the transformer loop and forming a first quasi loop with the radiator interface; and a meander line magnetic dipole radiator connected to the transformer loop and forming a second quasi loop with the radiator interface.

18. The antenna of claim 17, wherein the meander line magnetic dipole radiator is a capacitively-loaded magnetic dipole radiator.

19. The antenna of claim 17, wherein the linear magnetic dipole radiator is a linear capacitively-loaded magnetic dipole radiator.

20. The antenna of claim 17, wherein the meander line magnetic dipole radiator is a capacitively-loaded magnetic dipole radiator.

* * * * *

UNITED STATES PATENT AND TRADEMARK OFFICE

CERTIFICATE OF CORRECTION

PATENT NO. : 7,427,965 B2
APPLICATION NO. : 11/674564
DATED : September 23, 2008
INVENTOR(S) : Jorge Fabrega-Sanchez et al.

It is certified that error appears in the above-identified patent and that said Letters Patent is hereby corrected as shown below:

Title Page,
Item [63], replace "Oct. 12, 2006" with -- Oct. 12, 2005 --

Signed and Sealed this
First Day of May, 2012

David J. Kappos

David J. Kappos
*Director of the United States Patent and Trademark Office*